United States Patent [19]

Iizuka et al.

[11] Patent Number: 4,558,330

[45] Date of Patent: Dec. 10, 1985

[54] THERMAL PRINTING HEAD

[75] Inventors: Jiro Iizuka, Tokyo; Takatoshi Kaneko, Machida; Tooru Hashiba, Tokyo, all of Japan

[73] Assignee: Victor Company of Japan, Ltd., Japan

[21] Appl. No.: 670,807

[22] Filed: Nov. 13, 1984

[30] Foreign Application Priority Data

Nov. 14, 1983 [JP] Japan ..... 58-212424

[51] Int. Cl.[4] ..... B41J 3/20

[52] U.S. Cl. ..... 346/76 PH; 219/543; 358/298

[58] Field of Search ..... 346/76 PH, 76 R, 155, 346/139 R, 139 C; 219/216, 216 PH, 543; 400/120; 358/296, 298; 338/308

[56] References Cited

FOREIGN PATENT DOCUMENTS 2772 6/1982 Japan ..... 400/120

*Primary Examiner*—E. A. Goldberg

*Assistant Examiner*—A. Evans

*Attorney, Agent, or Firm*—Andrus, Sceales, Starke & Sawall

[57] ABSTRACT

A thermal printing head with first through n-th heating elements with respect to at least one printing line, where n is an integer, and an i-th heating element among the first through n-th heating element has an area of $M/2^i$ when a total area of one picture element is represented by M, where i is an arbitrary integer. The first through n-th heating elements are arranged at positions such that printing areas of the first through n-th heating elements do not overlap each other when the first through n-th heating elements carry out printing with respect to one picture element.

10 Claims, 8 Drawing Figures

THERMAL PRINTING HEAD

BACKGROUND OF THE INVENTION

The present invention generally relates to thermal printing heads, and more particularly to a thermal printing head which comprises first through n-th heating elements with respect to one printing line, where n is an integer, and a k-th heating element has an area of $M/2^i$ when a total area of one picture element is represented by M, where i and k are arbitrary natural numbers between one and n.

Recently, it is common to obtain a digital signal by subjecting signals such as a video signal and a graphic signal which is obtained from a personal computer to an analog-to-digital (A/D) conversion, and supply the digital signal to a printing apparatus so as to print a picture or graphics on a printing paper. Printing apparatuses may be roughly divided into impact type printing apparatuses and non-impact type printing apparatuses. An impact type printing apparatus generally comprises a head having a plurality of wire-dots, and characters or the like are printed on the printing paper when the wire-dots strike an ink ribbon placed on top of the printing paper. However, in the impact type printing apparatus, a large mechanical noise is generated during the printing operation due to the striking action of the wire-dots. Further, there is a disadvantage in that the resolution of the printed characters or the like is low.

On the other hand, non-impact type printing apparatus may be roughly divided into ink-jet type printing apparatuses and thermal transfer type printing apparatuses. An ink-jet type printing apparatus generally comprises a head having a plurality of nozzles, and characters or the like are printed on the printing paper when ink is sprayed onto the printing paper from the nozzles. Compared to the impact type printing apparatus, the ink-jet type printing apparatus is advantageous in that only a small mechanical noise is generated during the printing operation. However, there is a disadvantage in that the nozzles are easily blocked by paper and dust particles which adhere to the nozzles.

A thermal transfer type printing apparatus comprises a thermal printing head. Characters or the like are printed on the printing paper when the thermal printing head heats an ink film placed on top of the printing paper, or when the thermal printing head heats the surface of a printing paper which has a special coating. The printing paper which has the special coating darkens at parts where the surface thereof is heated. Compared to the impact type printing apparatus, the thermal transfer type printing apparatus is advantageous in that only a small mechanical noise is generated during the printing operation. Moreover, the problem of paper and dust particles adhering on the nozzles and blocking the nozzles as in the case of the ink-jet type printing apparatus, will not occur in the thermal transfer type printing apparatus. Theoretically, it is possible to use the same thermal printing head when carrying out the printing with respect to the printing paper by use of the ink film and when carrying out the printing with respect to the printing paper which has the special coating.

As one example of a conventional thermal printing head, there is a thermal printing head which comprises a heating dot element having an area which is the same as the area of one picture element. In this conventional thermal printing head, the heating area of the heating dot element is controlled by controlling the voltage or the like which is applied to the heating dot element, so as to print one picture element with a desired tone (gradation). However, it is extremely difficult to linearly control the heating area of the heating dot element. For this reason, it is extremely difficult to print a picture or the like with the desired tone by use of this conventional thermal printing head.

As another example of a conventional thermal printing head, there is a thermal printing head which comprises a plurality of heating dot elements with respect to the area of one picture element. According to this conventional thermal printing head, the heating dot elements are selectively heated so as to print one picture element with the desired tone. When printing one picture element with one tone out of 64 possible tones, for example, one picture element is described by a maximum of an $8\times8$ matrix of dots. In this case, it is necessary to employ a thermal printing head having 8 heating dot elements arranged in a vertical row, and the printing with respect to one picture element is completed when the 8 heating dot elements are selectively heated as the vertical row of 8 heating dot elements move in the horizontal direction by a distance of 8 heating dot elements. Accordingly, in this conventional thermal printing head, it is necessary to provide 8 times the number of heating dot elements required in the aforementioned conventional thermal printing head which controls the heating area of the heating dot element, and the manufacturing cost of the printing apparatus becomes high. Further, since the printing with respect to one picture element is carried out while the thermal printing head moves in the horizontal direction by a distance of 8 heating dot elements, the time it takes to print one picture element is 8 times longer than the time required in the aforementioned conventional thermal printing head which controls the heating area of the heating dot element.

SUMMARY OF THE INVENTION

Accordingly, it is a general object of the present invention to provide a novel and useful thermal printing head in which the problems described heretofore are eliminated.

Another and more specific object of the present invention is to provide a thermal printing head which comprises first through n-th heating elements with respect to one printing line, where n is an integer, and a k-th heating element has an area of $M/2^i$ when a total area of one picture element is represented by M, where i and k are arbitrary natural numbers between one and n. According to the thermal printing head of the present invention, it is possible to carry out a printing operation with one tone out of a large number of possible tones, by use of a small number of heating elements. In addition,it is possible to stably and linearly control the tone with which the printing is to be carried out.

Other objects and further features of the present invention will be apparent from the following detailed description when read in conjunction with the accompanying drawings.

DETAILED DESCRIPTION

Figure 1:
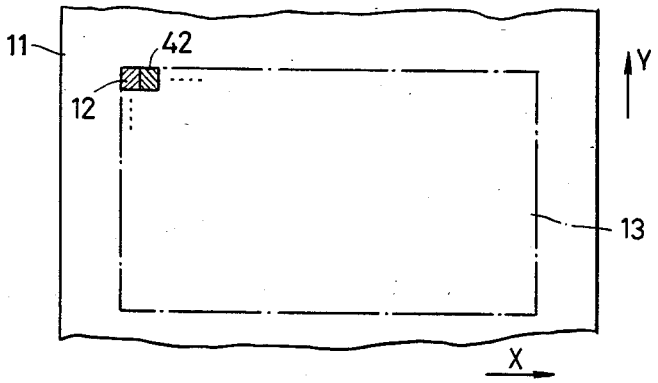
FIG. 1 shows printing positions of picture elements which are printed on a printing paper by a thermal printing head according to the present invention.

FIG. 1 shows printing positions of picture elements which are printed on a printing paper by a thermal printing head according to the present invention. In FIG. 1, an arbitrary printing range 13 on a thermal transfer paper (hereinafter simply referred to as a printing paper) 11, is indicated by a one-dot chain line. For convenience' sake, it will be assumed that the printing paper 11 has a special coating and that a picture or the like is printed on the printing paper 11 when a thermal printing head (not shown) heats the surface of the printing paper 11 at predetermined portions thereof. The thermal printing head prints a first picture element 12 in a first horizontal line, and thereafter prints remaining picture elements in this first line while moving in the direction of an arrow X. When the thermal printing head completes the printing of the first line, the thermal printing head is moved in a direction opposite to the direction of the arrow X and is returned to the original position. Further, a paper feeding mechanism (not shown) feeds the printing paper 11 by one line in the direction of an arrow Y. In this state, the thermal printing head starts to move in the direction of the arrow X so as to print a subsequent line.

Figure 2:
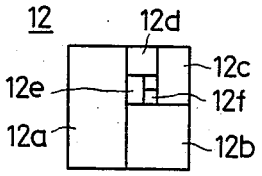
FIG. 2 is an enlarged view showing a method of dividing the area of one picture element into sections when printing one picture element with one tone out of 64 possible tones.

FIG. 2 is an enlarged view showing a method of dividing the area of one picture element into sections when printing one picture element with one tone (gradation) out of 64 possible tones (gradations), for example. When the total area of one picture element is represented by M, a first picture element part 12*a* has an area of M/2, and a second picture element part 12*b* has an area of M/4 which is ½ the area of the first picture element part 12*a*. A third picture element part 12*c* has an area of M/8 which is ½ the area of the second picture element part 12*b*. Similarly, fourth, fifth, and sixth picture element parts 12*d*, 12*e*, and 12*f* respectively have areas of M/16, M/32, and M/64.

Figure 3:
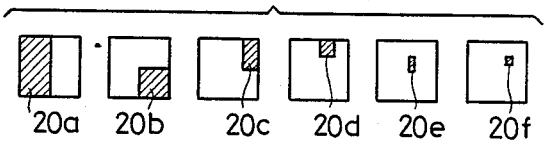
FIG. 3 shows the area and position of six heating elements with respect to one picture element when the printing one picture element with one tone out of 64 possible tones.

FIG. 3 shows the area and position of six heating resistor bodies (hereinafter simply referred to as heating elements) with respect to one picture element when the printing one picture element with one tone out of 64 possible tones. In FIG. 3, the heating elements are indicated by hatchings. A heating element 20*a* has an area of M/2, and is used to print the first picture element part 12*a* of picture element 12 shown in FIG. 2. Similarly, heating elements 20*b* through 20*f* respectively have areas of M/4, M/8, M/16, M/32, and M/64, and are used to print respective picture element parts 12*b* through 12*f* of the picture element 12 shown in FIG. 2. It is possible to print one picture element with one tone out of 64 possible tones, by selectively heating the heating elements 20*a* through 20*f* and carrying out the printing with respect to the one picture element. For example, when printing the picture element 12 with the brightest tone out of the 64 possible tones, none of the heating elements 20*a* through 20*f* are heated, and the picture element 12 is printed as a blank. When printing the picture element 12 with the second brightest tone out of the 64 possible tones, only the heating element 20*f* which has the smallest area is heated. In other words, the remaining heating elements 20*a* through 20*e* are not heated, and only the heating element 20*f* carries out the printing with respect to the picture element part 12*f* of the picture element 12. On the other hand, when printing the picture element 12 with the darkest tone out of the 64 possible tones, all of the heating elements 20*a* through 20*f* are heated, and the heating elements 20*a* through 20*f* carry out the printing with respect to the respective picture element parts 12*a* through 12*f* of the picture element 12.

Figure 4:
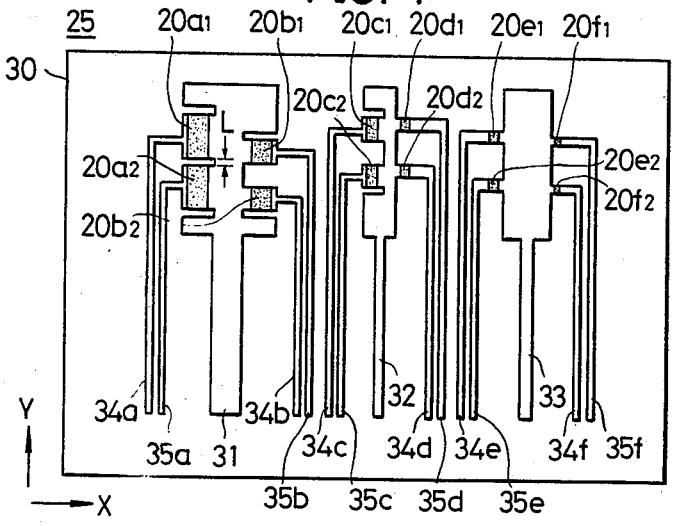
FIG. 4 shows an embodiment of a thermal printing head according to the present invention.

FIG. 4 shows an embodiment of a thermal printing head according to the present invention. In the present embodiment, a thermal printing head 25 is designed to simultaneously print two lines. The head 25 comprises a base plate 30, and common conductor parts 31, 32, and 33 are provided on the base plate 30. Heating elements 20*a*1, 20*b*1, 20*a*2, and 20*b*2 are provided on the conductor part 31. Similarly, heating elements 20*c*1, 20*d*1, 20*c*2, and 20*d*2 are provided on the conductor part 32, and heating elements 20*e*1, 20*f*1, 20*e*2, and 20*f*2 are provided on the conductor part 33. Lead wires 34*a* through 34*f* are connected to the respective heating elements 20*a*1 through 20*f*1 which are provided with respect to the first printing line. Further, lead wires 35*a* through 35*f* are connected to the respective heating elements 20*a*2 through 20*f*2 which are provided with respect to the second printing line.

First, description will be given with respect to the printing operation of the heating elements 20*a*1 through 20*f*1. When the head 25 is to carry out the printing with respect to the picture element 12 shown in FIG. 1, the head 25 is positioned so that the heating element 20*f*1 is in a position to carry out the printing with respect to the picture element part 12*f* of the picture element 12 shown in FIG. 2 at the start of the printing operation. The heating element 20f1 is heated or not heated depending on a desired tone with which the picture element 12 is to be printed, and the heating element 20f1 carries out the printing with respect to the picture element part 12f of the picture element 12. Next, the head 25 is shifted by one picture element in the direction of the arrow X by a head moving mechanism (not shown). In this state, the head 25 is positioned so that the heating element 20*e*1 is in a position to carry out the printing with respect to the picture element part 12*e* of the picture element 12. In addition, in this state, the heating element 20*f*1 is in a position to carry out the printing with respect to a picture element 42 shown in FIG. 1 which is in the same line as the picture element 12 and is immediately subsequent to the picture element 12. Accordingly, the heating element 20*e*1 is heated or not heated depending on the desired tone with which the picture element 12 is to be printed and carries out the printing with respect to the picture element part 12*e* of the picture element 12, and at the same time, the heating element 20*f*1 carries out the printing with respect to a predetermined picture element part of the picture element 42, which predetermined picture element part corresponds to the picture element part 12*f* of the picture element 12.

In FIG. 4, the heating elements 20*a*1 through 20*f*1 (and 20*a*2 through 20*f*2) are not arranged within the area of one picture element, but are distributed in the direction of the arrow X in terms of one picture element. This is because the area of one picture element is 250 μm×250 μm, for example, and is extremely small. It is virtually impossible to connect lead wires to six heating elements which are all arranged within the area of one picutre element.

Next, when the head 25 is shifted by one picture element in the direction of the arrow X by the head moving mechanism, the lead wires 34*d*, 34*e*, 35*d*, and 35*e* oppose the picture element 12. This is because the area of one picture element is 250 μm×250 μm, for example, and is extremely small, and space must be reserved on the base plate 30 for providing the lead wires which are connected to the heating elements. Accordingly, in order for the heating element 20*d*1 to carry out the printing with respect to the picture element part 12*d* of the picture element 12, it is necessary to shift the head 25 in the direction of the arrow X by one more picture element. Similarly thereafter, the head 25 is successively shifted by one picture element in the directin of the arrow X while the heating elements 20*a*1 through 20*f*1 are selectively heated, and the printing of one line is completed.

The heating elements 20*a*2 through 20*f*2 operate in the same manner as the heating elements 20*a*1 through 20*f*1, and description thereof will be omitted. When the heating element 20*f*1 is carrying out the printing with respect to the picture element 12, the heating element 20*f*2 is carrying out a printing with respect to the first picture element in the subsequent line. For this reason, two lines are printed simultaneously as the head 25 is successively shifted in the direction of the arrow X. When two lines are simultaneously printed in this manner, the head 25 is returned to the original position, and the printing paper 11 is fed by two lines in the direction of the arrow Y by a paper feeding mechanism (not shown). The head 25 then starts to move in the direction of the arrow X so as to simultaneously print the next two lines.

When the simultaneous printing of the two lines is completed, it is possible to simply feed the printing paper 11 by two lines in the direction of the arrow Y by the paper feeding mechanism, and not return the head 25 to the original position. In this case, the head 25 is successively shifted by one picture element in a direction opposite to the direction of the arrow X, so as to simultaneously print the next two lines. By carrying out the printing even while the head 25 returns to the original position, it is possible to improve the printing efficiency and reduce the printing time compared to the case where the head 25 is returned to the original position every time two lines are printed. In the case where the head 25 is returned to the original position every time two lines are printed, the printing with respect to one picture element is started from the heating element having the smallest area. However, in the case where the head 25 also carries out the printing as the head 25 returns to the original position, the printing with respect to one picture element is alternately started from the picture element having the smallest area and the picture element having the largest area, for every other line. The resolution of the printed picture or the like which is obtained when the printing with respect to each picture element is alternately carried out from the heating element having the smallest area and the heating element having the largest area, is slightly poorer compared to the resolution of the picture or the like which is obtained when the printing with respect to each picture element is constantly carried out from the heating element having the smallest area.

Figure 5:
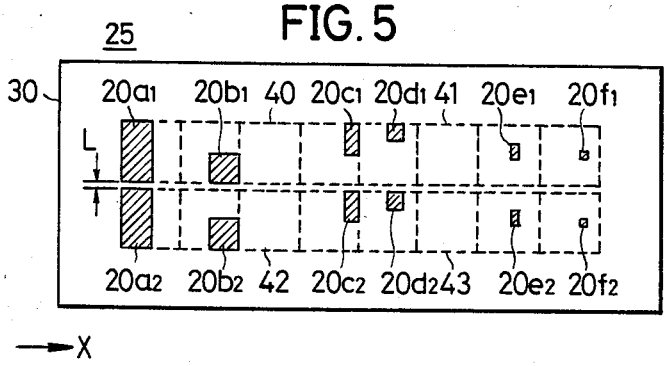
FIG. 5 shows the positional relationships among heating elements of the thermal printing head shown in FIG. 4.

FIG. 5 shows the positional relationships among heating elements of the thermal printing head shown in FIG. 4. In FIG. 5, a square indicated by phantom lines indicates the total area of one picture element, and the position of the heating element is indicated by hatchings. The illustration of the lead wires and conductor parts is omitted in FIG. 5. As described before, it is necessary to reserve space on the base plate 30 for providing the lead wires. Thus, spaces 40 through 43 each corresponding to one picture element, are respectively provided between the heating elements 20*b*1 and 20*c*1, 20*d*1 and 20*e*1, 20*b*2 and 20*c*2, and 20*d*2 and 20*e*2. Accordingly, when the heating elements 20*a*1 through 20*f*1 carry out the printing with respect to one picture element, the head 25 is successively shifted by 8 picture elements in the direction of the arrow X.

Figure 6:
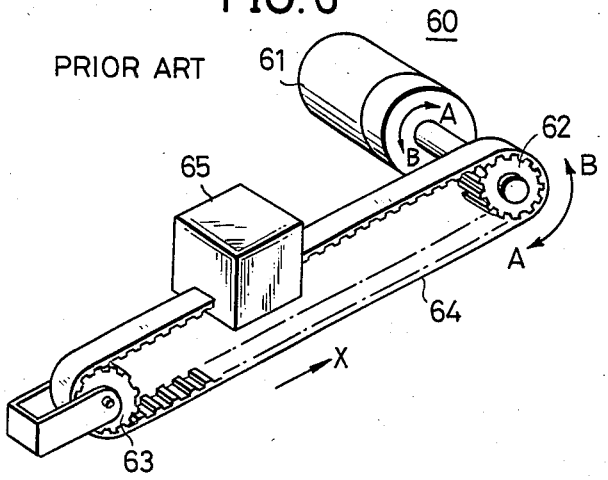
FIG. 6 PRIOR ART
FIG. 6 shows an example of a head moving mechanism.

For example, a known head moving mechanism 60 shown in FIG. 6 may be used to successively shift the head 25 in the direction of the arrow X. In FIG. 6, the head moving mechanism 60 comprises a motor 61, a pulley 62 fixed to a rotary shaft of the motor 61, a pulley 63, a belt 64 provided across the pulleys 62 and 63, and a carriage 65. The head 25 is provided on the carriage 65.

When the motor 61 rotates in the direction of an arrow A, the pulley 62 also rotates in the direction of the arrow A, and the carriage 65 is accordingly moved in the direction of the arrow X. Hence, by rotating the motor 61 in the direction of the arrow A in steps, it is possible to successively shift the carriage 65, and thus the head 25, in the direction of the arrow X by one picture element. Similarly, the carriage 65 may be moved in the direction opposite to the direction of the arrow X, by rotating the motor 61 in the direction of an arrow B.

In the head 25 shown in FIG. 5, the spaces 40 through 43 are formed on the base plate 30 so that the lead wires may be provided on the base plate 30. In addition, a gap L is formed between the heating elements 20*a*1 and 20*a*2 so that the heating elements 20*a*1 and 20*a*2 do not make contact with each other. However, the arrangement of the heating elements is not limited to the arrangement shown in FIG. 5. For example, heating elements similar to the heating elements 20*a*1 through 20*f*1 may be provided with respect to three or more lines, so that the thermal printing head can simultaneously print three or more lines. Further, when the heating elements are provided with respect to three or more lines, for example, the number of lead wires increase accordingly, and in this case, a space corresponding to an integral multiple of one picture element may be formed between two heating elements which are provided with respect to the same line.

Figure 7:
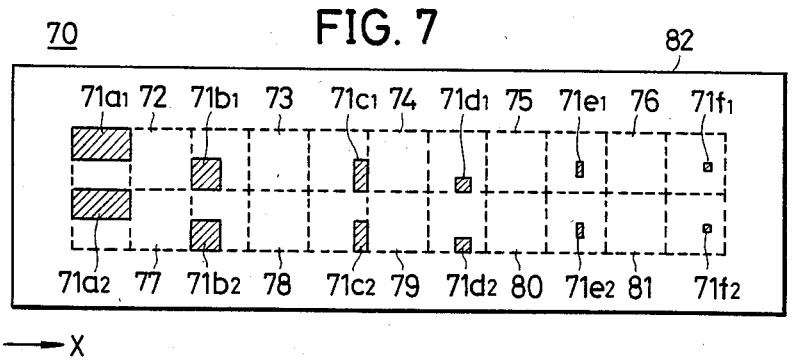
FIG. 7 shows a modification of the positional relationships among the heating elements of the thermal printing head.

FIG. 7 shows a modification of the positional relationships among the heating elements of the thermal printing head. In FIG. 7, the illustration of the lead wires and the conductor parts is omitted. In the present modification, the method of dividing the area of one picture element into sections when printing one picture element with one tone out of 64 possible tones, is slightly different from the method shown in FIG. 2. However, the areas of heating elements 72a1 through 71f1 (and 71a2 through 71f2) provided on a base plate 82 of a thermal printing head 70 shown in FIG. 7, are the same as the respective areas of the heating elements 20a through 20f shown in FIG. 3. Spaces 72 through 81 are formed so that the necessary lead wires may be provided on the base plate 82. According to the present modification, the head 70 is shifted by 11 picture elements in the direction of the arrow X while all of the heating elements 71a1 thorugh 71f1 carry out the printing with respect to one picture element. Because the heating elements 71a1 through 71f1 and 71a2 through 71f2 are arranged as shown in FIG. 7, it is unnecessary to form the gap L as in the case of the embodiment shown in FIG. 5.

In the embodiment shown in FIG. 5 and the modification shown in FIG. 7, the heating elements of the thermal printing head are arranged so that the area of the heating element which carries out the printing with respect to one picture element is multiplied by 2 as the thermal printing head is successively shifted in the direction of the arrow X. However, the heating elements may be arranged in the reverse sequence so that the heating element which carries out the printing with respect to one picture element is divided by 2 as the thermal printing head is successively shifted in the direction of the arrow X. Furthermore, the heating elements may be arranged at random. In other words, when the thermal printing head comprises first through n-th heating elements, where n is an integer, the area of a k-th heating element needs to be $M/2^i$ when the total area of one picture element is represented by M, where i and k are arbitrary natural numbers between one and n, and moreover, the first through n-th heating elements need to be arranged at positions such that the printing areas of the first through n-th heating elements do not overlap when the first through n-th heating elements carry out the printing with respect to one picture element. In a case where the thermal printing head comprises i heating elements with respect to one printing line, it is possible to print one picture element with one tone out of i possible tones.

Next, description will be given with respect to the operation of a printing apparatus which is applied with the thermal printing head according to the present invention, by referring to FIG. 8.

Figure 8:
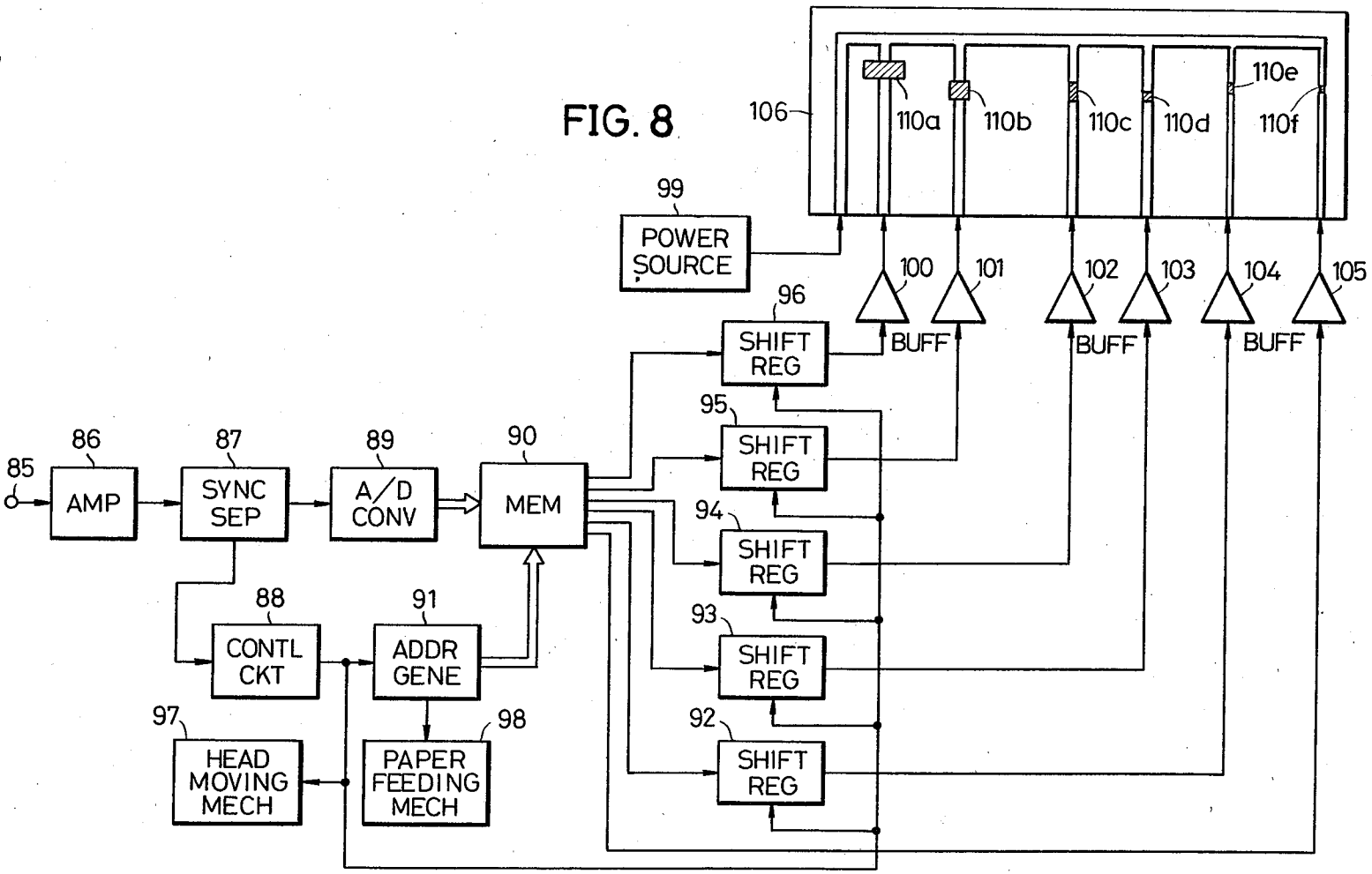
FIG. 8 is a general systematic block diagram showing a printing apparatus applied with the thermal printing head according to the present invention.

In FIG. 8, and NTSC system composite video signal, for example, is applied to an input terminal 85 and is supplied to a buffer amplifier 86. An output signal of the buffer amplifier 86 is supplied to a synchronizing signal separating circuit 87, and a horizontal synchronizing signal and a vertical synchronizing signal which are separated from the composite video signal are respectively supplied to a control circuit 88. On the other hand, an output video signal of the separating circuit 87 is supplied to an analog-to-digital (A/D) converter 89. The output video signal of the separating circuit 87 is converted into a digital signal in the A/D converter 89. For convenience' sake, when it is assumed that the printing of one picture element is to be carried out with one tone out of 64 possible tones, the output digital signal in the A/D converter 89 is a 6-bit signal. The output digital signal of the A/D converter 89 is supplied to a memory 90.

An address generating circuit 91 generates a write-in address within the memory 90, responsive to an output signal of the control circuit 88. The output digital signal of the A/D converter 89 corresponding to one line (containing 512 data in the horizontal direction, for example) or one picture, is stored in the memory 90 according to the write-in addresses designated by the address generating circuit 91. When the digital signal corresponding to one line or one picture is stored in the memory 90 and the printing apparatus is set to a printing mode, the address generating circuit 91 generates a read-out address within the memory 90, responsive to the output signal of the control circuit 88. Hence, the stored data corresponding to one line or one picture, are successively read out from the memory 90 according to the read-out addresses designated by the address generating circuit 91. The 6-bit data which are successively read out from the memory 90, each describe one picture element with one tone out of 64 possible tones.

A thermal printing head 106 comprises heating elements 110a through 110f which are arranged similarly as the heating elements 71a1 through 71f1 shown in FIG. 7. For convenience' sake, it will be assumed that the head 106 only prints one line at a time. Each of the heating elements 110a through 110f has one end commonly connected to each other and coupled to a power source 99. The other ends of the heating elements 110a through 110f are connected to output terminals of respective buffers 100 through 105. The head 106 is shifted in terms of one picture element by a head moving mechanism 97 which operates responsive to an output signal of the control circuit 88. For example, the head 106 is shifted by one picture element when the control circuit 88 supplies one pulse to the head moving mechanism 97. A printing paper (not shown) on which a picture or the like is to be printed, is fed in terms of one line by a paper feeding mechanism 98 which operates responsive to an output signal of the address generating circuit 91. For example, when the printing with respect to one line is completed, the address generating circuit 91 generates one pulse, and the paper feeding mechanism 98 feeds the printing paper by one line responsive to this output pulse of the address generating circuit 91.

Shift registers 92 through 96 are each designed to successively shift an input data responsive to an output signal of the control circuit 88. The shift registers 92 through 96 are 2-bit, 4-bit, 6-bit, 8-bit, and 10-bit shift registers, respectively.

The address generating circuit 91, the head moving mechanism 97, and the shift registers 92 through 96 respectively operate in synchronism with the output of the control circuit 88.

It will be assumed that data corresponding to one line which contains 512 picture elements, are stored in the memory 90. In this case, the address generating circuit 91 first designates the address within the memory 90 where a data which is related to the first picture element on the one line is stored. Accordingly, a 6-bit data related to the first picture element (for example, the picture element 12 shown in FIG. 1), is read out from the memory 90. A signal of a first bit of the 6-bit data which is read out from the memory 90, is supplied to the heating element 110f through the buffer 105. Hence, the heating element 110f is heated, for example, and the printing operation of the heating element 110f with respect to the first picture element is completed. In this state, signals of the remaining second through sixth bits of the 6-bit data which is read out from the memory 90, are supplied to the respective shift registers 92 through 96. For this reason, no signals are applied to the heating elements 110*a* through 110*e*.

Next, the control circuit 99 produces a first pulse, and the head moving mechanism 97 shifts the head 106 by one picture element in the direction of the arrow X in FIG. 1 responsive to this first pulse. In addition, the address generating circuit 91 increments the read-out address by one responsive to the first pulse from the control circuit 88. The shift registers 92 through 96 respectively shift the signals of the second through sixth bits of the 6-bit data which is related to the first picture element, responsive to the first pulse from the control circuit 88, and at the same time, the shift registers 92 through 96 enter signals of second through sixth bits of a 6-bit data which is related to a second picture element (the picture element 42 shown in FIG. 1, for example) on the same line and is read out from the memory 90. A signal of the remaining first bit of the 6-bit data which is related to the second picture element, is supplied to the heating element 110*f* through the buffer 105, and thus, the heating element 110*f* carries out the printing with respect to the second picture element.

Similarly thereafter, the heating elements 110*a* through 110*f* carry out the printing with respect to each picture element in the same line. The heating element 110*e* carries out the printing with respect to the first picture element when the control circuit 88 produces a second pulse. This is because the shift register 92 produces the signal of the second bit of the 6-bit data which is related to the first picture element, responsive to the second pulse which is produced from the control circuit 88. Therefore, the heating element 110*a* carries out the printing with respect to the first picture element when the control circuit 88 produces a tenth pulse, and at this point in time, the heating element 110*f* carries out the printing with respect to a tenth picture element in the same line.

As is clear from the description given heretofore, the printing of one line which contains 512 picture elements is completed when the control circuit 88 produces a 522-nd (=512=10) pulse, that is, when the heating element 110*a* completes the printing with respect to a 512-th picture element. When the printing of one line is completed in this manner, the paper feeding mechanism 98 feeds the printing paper by one line in the direction of the arrow Y in FIG. 1 responsive to an output signal of the address generating circuit 91. Further, the head moving mechanism 97 moves the head 106 in a direction opposite to the direction of the arrow X responsive to an output signal of the control circuit 88, so as to return the head 106 to the original position. The printing apparatus is then ready to carry out the printing with respect to the next line. One picutre containing a plurality of lines may be printed by repeating the operations described heretofore.

As described before, it is not essential to return the head 106 to the original position when the head 106 is moved in the direction of the arrow X and the printing with respect to one line is completed, and the printing with respect to the next line may be carried out as the head 106 is successively shifted by one picture element in the direction opposite to the direction of the arrow X. In this case, the sequence with which the data are stored in the memory 90, or the sequence with which the data are read out from the memory 90, should be reversed for every other line.

One heating element is heated for approximately 1 msec, for example, and it takes approximately 2 msec for the head moving mechanism 97 to shift the head 106 by one picture element. Accordingly, when it is assumed that one line contains 512 picture elements as described before, it takes approximately 1566 (=3×522) msec to print one line. For example, when one picture is represented by a 512×512 matrix of picture elements (that is, 512 lines), it takes approximately 800 (=1.566×512) sec, that is, approximately 14 minutes, to print one picture. However, it woud be impractical to spend such a long time to print one picture, and in reality, the thermal printing head is designed to simultaneously print a plurality of lines. For example, when the thermal printing head is designed to simultaneously print 16 lines, one picture can be printed within approximately 50 (=800/16) sec.

For convenience' sake, the printing operation of the thermal printing head according to the present invention was described heretofore for a case where the printing paper has a special coating. However, it is of course possible to apply the thermal printing head according to the present invention to a printing apparatus which employs an ink film.

Further, the present invention is not limited to these embodiments, but various variations and modification may be made without departing from the scope of the present invention.

What is claimed is

1. A thermal printing head comprising first through n-th heating elements for printing, where n is a natural number greater than one, a k-th heating element among said first through n-th heating elements having an area of $M/2^i$ when a total area of one picture element is represented by M, where each of k and i is a natural number which is selected from among one through n so that respective areas of said first through n-th heating elements are different from each other, said first through n-th heating elements being arranged substantially along a printing line at such positions that the areas of said first through n-th heating elements correspond to different picture element parts of one picture element in the printing line which is to be printed, said different picture element parts of said one picture element not overlapping with each other.

2. A thermal printing head as claimed in claim 1 in which said one picture element is printed as said thermal printing head is successively shifted along the printing line in terms of a predetermined unit, said predetermined unit being a natural number multiple of a length of said one picture element in a direction of the printing line.

3. A thermal printing head as claimed in claim 2 in which said first through n-th heating elements are arranged so that the printing with respect to said one picture element is successively carried out by the first through n-th heating elements in a sequence of the n-th, (n-1)-th, (n-2)-th, . . . , second, and first heating elements such that a printing carried out with respect to said one picture element by a heating element having a smaller area always precedes a printing carried out with respect to said one picture element by a heating element having a larger area.

4. A thermal printing head as claimed in claim 1 which is designed to simultaneously print l lines, where l is a natural number greater than or equal to two, and n heating elements are provided with respect to each of said l lines.

5. A thermal printing head as claimed in claim 1 in which said natural number n is equal to 6, and said thermal printing head carries out the printing with respect to said one picture element with one tone out of 64 possible tones.

6. A thermal printing head as claimed in claim 1 which prints a picture or the like on a printing paper which has a special coating, prints being formed on the printing paper as the heating elements heat the surface of the printing paper at predetermined parts thereof.

7. A thermal printing head as claimed in claim 1 which prints a picture or the like on a printing paper, prints being formed on the printing paper as the heating elements heat an ink film placed on top of the printing paper and melt ink which is thereby transferred onto the printing paper.

8. A thermal printing head as claimed in claim 2 in which each of said first through n-th heating elements is supplied with one bit of an n-bit digital signal which indicates a tone of printing of said one picture element.

9. A thermal printing head as claimed in claim 8 in which said n-bit digital signal is a signal read out from a memory which stores digital video data corresponding to one line or one picture.

10. A thermal printing head as claimed in claim 4 in which n heating elements provided with respect to a predetermined line among said l lines, are arranged so as not to make contact with any of n heating elements provided with respect to a line which is adjacent to said predetermined line.

* * * * *

UNITED STATES PATENT AND TRADEMARK OFFICE

CERTIFICATE OF CORRECTION

PATENT NO. : 4,558,330

DATED : December 10, 1985

INVENTOR(S) : JIRO IIZUKA ET AL

It is certified that error appears in the above-identified patent and that said Letters Patent is hereby corrected as shown below:

Column 5, Line 13, Cancel "picutre" and substitute therefor---picture---;

Column 5, Line 28, Cancel "directin" and substitute therefor---direction---;

Column 7, Line 3, Cancel "72al" and substitute therefor---71al---;

Column 9, Line 41, Cancel "(= 512 = 10)" and substitute therefor---(= 512 + 10)---;

Column 9, Line 53, Cancel "picutre" and substitute therefor---picture---;

Column 10, Line 63, After "print" delete "1" and substitute therefor---ℓ ---;

Column 10, Line 64, After "print" delete "1" and substitute therefor---ℓ ---;

UNITED STATES PATENT AND TRADEMARK OFFICE

CERTIFICATE OF CORRECTION

PATENT NO. : 4,558,330

DATED : December 10, 1985

INVENTOR(S) : JIRO IIZUKA ET AL

It is certified that error appears in the above-identified patent and that said Letters Patent is hereby corrected as shown below:

Column 10, Line 66, After "print" delete "1" and substitute therefor---ℓ ---;

Column 12, Line 11, After "said" delete "1" and substitute therefor---ℓ ---.

Signed and Sealed this

*Twenty-second* Day of *July 1986*

[SEAL]

*Attest:*

DONALD J. QUIGG

*Attesting Officer*

*Commissioner of Patents and Trademarks*